United States Patent [19]

Ohmori

[11] Patent Number: 4,830,403

[45] Date of Patent: May 16, 1989

[54] ACCESSORY FOR PROTECTING AND HOLDING SKIS TOGETHER

[76] Inventor: Charles Z. Ohmori, 5460 Highland Dr., Bellevue, Wash. 98006

[21] Appl. No.: 185,680

[22] Filed: Apr. 25, 1988

[51] Int. Cl.[4] ..... A63C 11/02

[52] U.S. Cl. ..... 280/815; 280/814; 211/70.5; 294/147

[58] Field of Search ..... 280/814, 815, 818, 47.13 R; 150/52 G; 211/70.5; 224/917; 294/147

[56] References Cited

U.S. PATENT DOCUMENTS

| | | | |
|---|---|---|---|
| 1,957,577 | 5/1934 | Chapman | 150/52 G |
| 2,118,875 | 5/1938 | Windheim | 224/917 X |
| 2,128,036 | 8/1938 | Butler, Jr. | 280/815 |
| 3,051,210 | 8/1962 | Mesinger | 150/52 G |
| 3,253,627 | 5/1966 | Koetting | 150/52 G |
| 4,152,002 | 5/1979 | Olson | 280/814 |
| 4,191,233 | 3/1980 | McKay | 280/814 X |

FOREIGN PATENT DOCUMENTS

| | | | |
|---|---|---|---|
| 3439278 | 8/1985 | Fed. Rep. of Germany | 280/814 |
| 79472 | 3/1932 | Sweden | 280/815 |
| 97838 | 1/1940 | Sweden | 280/815 |
| 581487 | 11/1976 | Switzerland | 280/814 |

*Primary Examiner*—Charles A. Marmor
*Assistant Examiner*—Brian L. Johnson
*Attorney, Agent, or Firm*—Wolder, Gross & Yavner

[57] ABSTRACT

An accessory for protecting and holding skis together which includes a top member and a bottom member. The top member is formed of two flexible wings conforming in shape to the shovel of a ski with a receptacle to receive the shovel. The wings are joined usually at their bottom surfaces of their inner walls by a thin flexible bridge. The walls of the wings have openings which are substantially aligned with each other when the wings are folded against themselves. The bottom member also forms a receptacle to receive the tails of the ski and is sized to be received within the openings of the walls of the wings.

14 Claims, 3 Drawing Sheets

FIG. 6
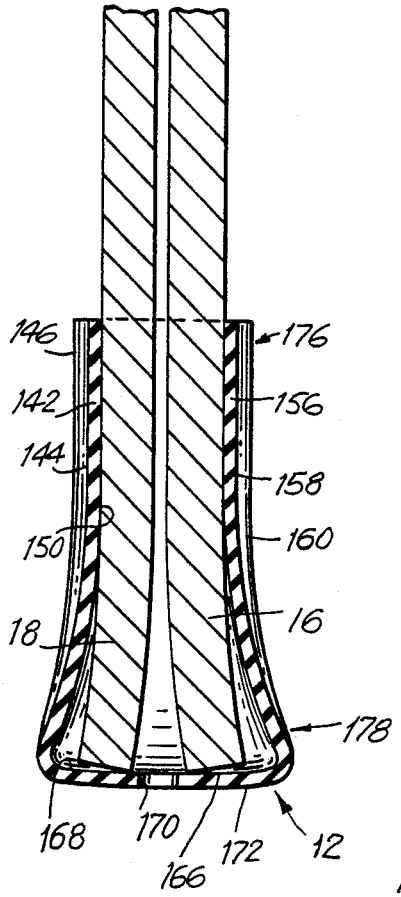
FIG. 7
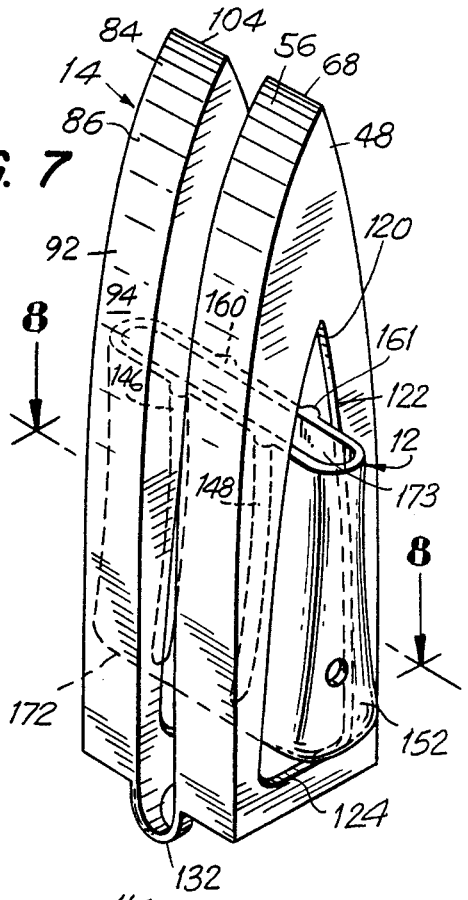
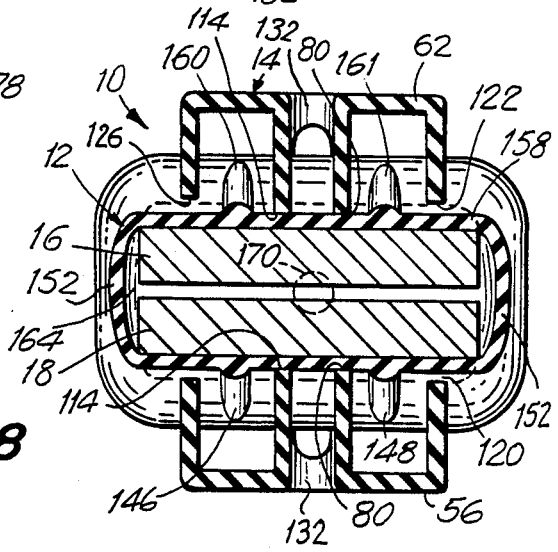
FIG. 8

ACCESSORY FOR PROTECTING AND HOLDING SKIS TOGETHER

BACKGROUND OF THE INVENTION

My invention relates to skiing accessories, and more particularly to an improved means for protecting, holding, carrying and/or temporarily storing skis in a manner that will respect public safety. Skis tend to be long and they have to be carried with both hands with a cradle-type grip or placed on the shoulders and held with one or two hands. They tend to separate easily. While in transport by ground or air, the skis, particularly the tips, can be damaged.

A major problem is to get the skis from the means of transportation to the ski lift area. Since there are sharp edges and tips on the ski, injury to nearby people and property can occur. There is no satisfactory retaining means that can hold the skis together, protect the skis from damage, minimize injury to others, and allow easy application and removal.

U.S. Pat. No. 4,152,002 discloses a ski boot carrier which uses the skis, themselves, as the lever arm. The skis simply are received within a sleeve 23. The flat portions of the skis are used. While this does provide a means to carry not only the skis, but also the boots, it does not protect other people or property and the ends of the skis, and can not be used for transport nor provides any means of temporary storage.

U.S. Pat. Nos. 1,957,577, 3,051,210 and 3,253,627 are all directed to covers for golf clubs. These were the closest references found that were directed to coverings for odd shapes. The '577 patent shows a double cover with what might be characterized as a form of flexible bridge. However, there is no structure that could support the skis to suggest solutions for the prior mentioned problems. Sometimes straps are used to wrap-tie the skis together, but again it does not solve or suggest a solution for the above problems.

OBJECTS AND ADVANTAGES OF THE PRESENT INVENTION

Accordingly, it is among the principal objects of the present invention to provide an improved ski accessory for holding skis together.

Yet another object of the present invention is to provide an improved ski accessory which will protect the skis while on ground, sea or air transportation.

Yet another object is to provide an improved ski accessory which, when being transported by a person will minimize injury to nearby persons and property.

Still yet a further object of the present invention is to provide an accessory of the character described which is designed for easy engagement and removal.

Yet another object of the present invention is to provide a device of the character described which will make it easy to store skis at least on a temporary basis.

Still another object of the present invention is to provide an improved ski accessory which will fit all skis, regardless of their length and accommodating for variations in width.

A further object of the invention is to provide a protecting and holding accessory which is capable of absorbing shock and punishment to a high degree without being damaged or causing damage to the skis.

A feature of the invention is to provide an invention which will reduce the volume of material used, making this reduction an integral part of the invention.

Yet another feature of the invention is to provide the lowest vertical point of the invention with a drain to prevent water damage occurring when the skis are stored.

Still yet another feature of the invention is to provide a two part accessory in which the bottom part is received within the top part with means to insure a normally non-permanent securement when not in use.

Still yet another object of the present invention is to provide an accessory of the character described which will be simple and economical to manufacture and yet be durable to a high degree in use.

The invention consists of a top sleeve member comprising two symmetrical, outwardly flaring ski shovel receptacle means or wings. They are joined by a flexible bridge member to guarantee that they do not separate. These wings receive the shovel portion of the skis. The fit is designed to be snug. As a result the member is made of a durable but sufficiently flexible plastic, rubber or similar materials. Examples of such materials are rubber, polypropylene and polyurethane.

The outer walls of the receptacle members are provided with rather large openings. The inner walls are provided with smaller openings designed to snugly receive the bottom sleeve member as hereinafter described.

The bottom sleeve member is also made of a flexible material but with a somewhat less resilient bottom portion. The same material can be used; it can just be made thicker than the top member. This member is designed to snugly receive the tails of pair of skis. Once again, they are snugly received. The bottom wall has a drain to allow any water from snow, etc., to leave the interior receptacle and thus eliminate any damage that might otherwise be caused should the skis be allowed to sit for any period of time.

The bottom member also is formed with two vertical, parallel ribs in spaced apart relationship. When the accessory is not in use the two wings of the top member are folded upwardly against themselves around the flexible bridge. The bottom member is then inserted through the openings with one of the ribs forced through the two inner openings. Because of the snug fit the outer surfaces of the inner walls of the wings abut the ribs, thus providing a simple means of retaining the two parts of the accessory in engagement when not in use. By simply pulling at the bottom member, the rib forces the inner walls to yield, causing the two parts to separate for use.

Placing the top member wings over the shovels of the skis and the bottom member over the tails the skis are engaged in a solid, firm manner.

The above description, as well as further objects and advantages of the present invention will be more fully appreciated with reference to the following detailed description of a preferred, but nonetheless illustrative embodiment of the invention, when taken in conjunction with the following drawings wherein:

FIG. 6 is a cross-sectional view taken along the lines 6—6 of FIG. 5;

FIG. 7 is a perspective view of the bottom sleeve member inserted into the openings of; the top member for storage purposes; and FIG. 8 is a cross-sectional view taken along the lines 8—8 of FIG. 7.

DETAILED DESCRIPTION OF THE INVENTION

Figure 1:
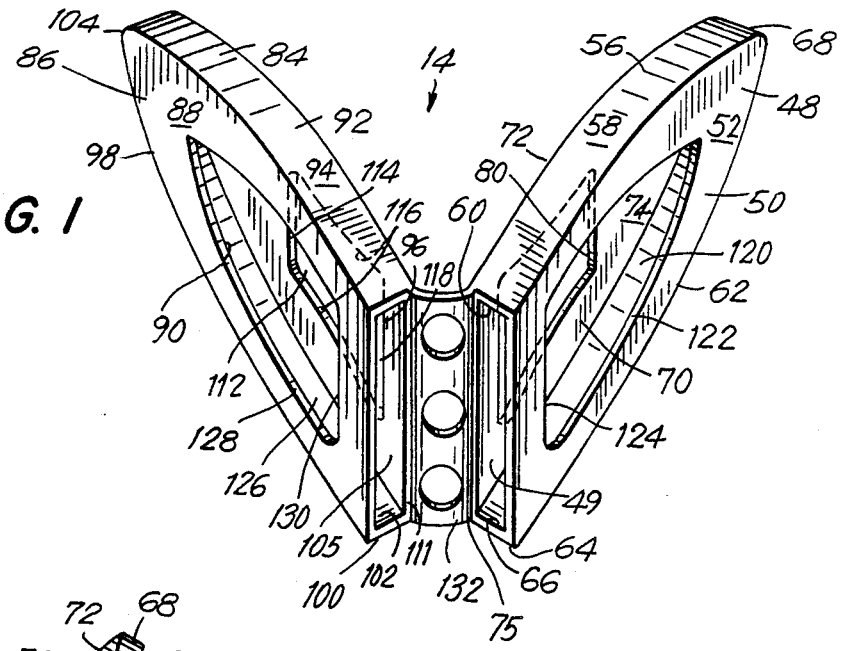
FIG. 1 is a perspective view of the top sleeve member embodying my new invention.
Figure 4:
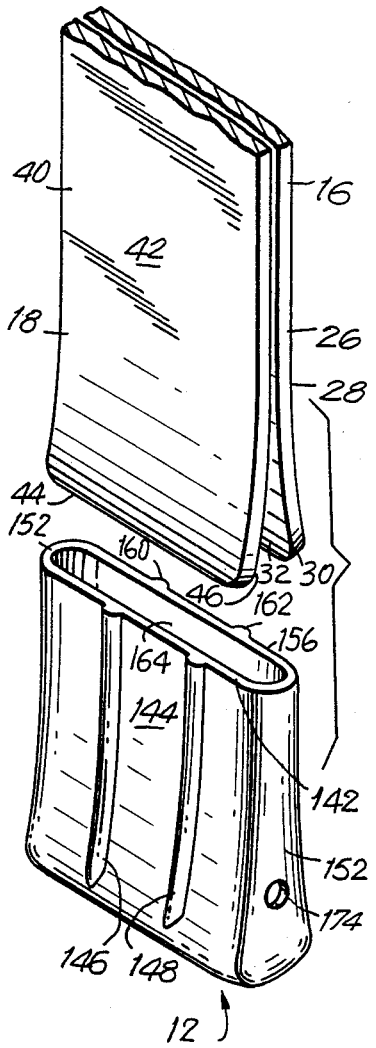
FIG. 4 is an exploded perspective view of the tails of the skis and a bottom sleeve member for covering the tails.

Turning in detail to the drawings and in particular to FIGS. 1, 4 and 8, there is shown an accessory 10 for protecting and holding skis together broadly comprising a bottom sleeve member 12 and a top sleeve member 14.

This accessory is designed for use with a pair of skis, and more specifically with snow skis. A typical pair of skis (FIG. 3) includes a first or right ski 16 and a second or left ski 18. The first ski as considered from the vertical has an upper end or shovel 20 which is flared outwardly in the well-known shape. The shovel is defined by an outer surface 22 and an inner surface 24. The other or bottom end of the right ski (FIG. 4) the tail 26 is defined by an outer surface 28, a bottom surface 30 and an inner surface 32. Similarly, the left ski 18 has a shovel 34 defined by an outer surface 36 and an inner surface 38. The tail 40 is defined by an outer surface 42, a bottom surface 44, and an inner surface 46.

Figure 2:
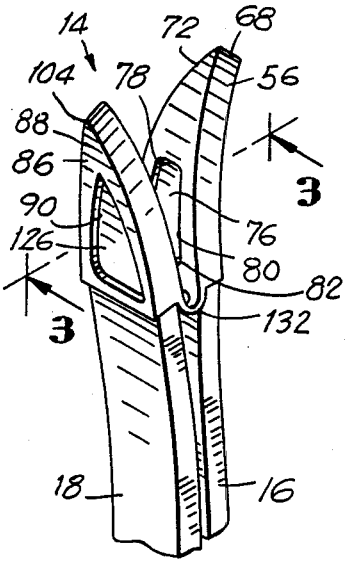
FIG. 2 is a partial perspective view of the member covering the shovels of the skis.

The top sleeve member includes a right wing or ski shovel receptacle means 48 (FIG. 1) made of a standard flexible plastic or rubber. It is similar in appearance to the shovel and is flared outwardly. It has a receptacle 49 to receive the shovel and has an outer wall 50 defined by an outer surface 52 and an inner surface 54. It further includes a front side wall 56 defined by an outer surface 58 and an inner surface 60. Oppositely disposed is rear side wall 62 defined by an outer surface 64 and an inner surface 66. The side walls meet at tip 68. Completing the enclosure is inner wall 70 defined by outer surface 72, inner surface 74, and bottom surface 75. The inner wall 70 has an inner opening 76 (FIG. 2) with a top wall 78, side walls 80, and a bottom wall 82.

The left wing or ski shovel receptacle means 84 (FIG. 1) has an outer wall 86 defined by an outer surface 88 and an inner surface 90. Secured to it is front side wall 92 defined by outer surface 94 and inner surface 96, as well as rear side wall 98 defined by outer surface 100 and inner surface 102. The side walls come together at tip 104. The receptacle 105 is enclosed by inner wall 106 defined (FIG. 3) by outer surface 108 and inner surface 110 with bottom surface, 111. The inner wall 106 has an inner opening 112 (FIG. 1) with a top wall 114, side walls 116 and a bottom wall 118.

The right wing 48 has an opening 120 (FIG. 1) in its outer wall 50. It is defined by side walls 122 and bottom wall 124. The openings are shown as resembling an isosceles triangle. It is also larger than inner opening 76. In a similar manner the outer wall 86 of left wing 84 has an outer opening 126 (FIG. 2) defined by side walls 128 and bottom wall 130.

The two shovels receptacle means 48, 84 are joined at the bottom surfaces 75,111 of their inner walls 70, 106 by a bridge 132 (FIG. 1) defined by an inner surface 134 (FIG. 3) and an outer surface 136. The bridge joins the inner walls at edges 138, 139. The bridge may have holes 140 to lessen the amount of material required to fabricate the article and to increase the flexibility of the bridge. The purpose of the bridge is to hold the two wings together and thus holding the two skis together. Accordingly, the bridge in addition to being constructed as shown could be any type of connection, made of any appropriate material. For example a single (or multiple) perpendicular strip would be appropriate. An elastic hook could also be used. Furthermore, the bridge could join the wings to each other at their tips or side walls as well as the bottom walls.

Figure 5:
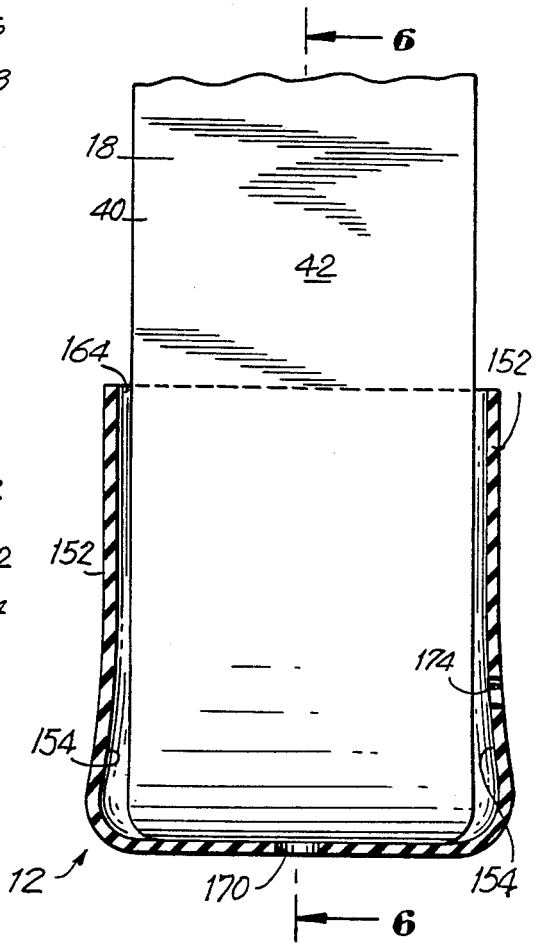
FIG. 5 is a cross-sectional view of the member engaged on the tail of the ski.

The bottom sleeve member 12 (FIG. 4) has a front wall 142 defined by an outer surface 144. Protruding from this surface are two vertical, parallel, spaced ribs 146, 148 for the purpose to be described hereafter. The wall is also defined by an inner surface 150 (FIG. 6). Furthermore, the member has two oppositely disposed side walls (FIG. 5) 152 with inner surface 154, as well as a rear wall 156 with outer surface 158. Again in a similar manner protruding from this surface are two ribs 160, 162 oppositely disposed from and aligned with ribs 146, 148. The rear wall also has an inner surface 164. The bottom wall 166 is defined by an inner surface 168 with a drain hole 170 passing through to an outer surface 172. The walls 142, 156, 166 define a receptacle 173. Alternatively, there may be a plurality of drain holes, or the hole configuration may be replaced by other shapes such as a slit. Furthermore, a hole (or slit) 174 may be positioned in one or both of the side walls 152 to prevent a vacuum pressure from stopping easy draining.

In use the two members 12, 14 are stored together as seen in FIGS. 7 and 8. The wings 48, 84 are pivoted around bridge 132 toward each other as seen in FIG. 7 and member 14 is inserted through openings 76, 112. The dimensions of the openings are the same in configuration to the member 14 except they are slightly larger. As the member 12 is forced through the openings (as well as the larger openings 120, 126) the ribs 146, 148, 160, 162 press against the walls 80, 116 which yield an firmly grasp the ribs 144, 158 of the walls 142, 156. The ribs then are received within the interior space as best seen in FIG. 8, being on the outside of the walls 80, 116. The two members will not separate, since sliding movement is stopped by the ribs.

Figure 3:
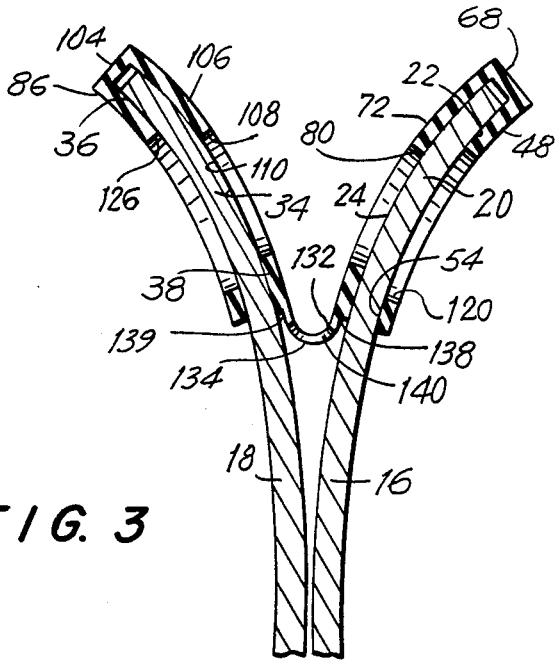
FIG. 3 is a cross-sectional view taken along the lines 3—3 of FIG. 2.

When it is desired to use the accessory with skis, the members are separated. The top member 14 is then stretched over the shovels of a pair of skis as shown in FIG. 3. The tails of the skis are then held together (FIG. 4) and they are forced into the receptacle in the bottom member 14 (FIG. 6). Since the upper portion 176 of the bottom member 12 is thinner than the bottom portion 178 it is more flexible, making it easier to insert the tails of the skis. The normal bowing in the skis and the resilience in the members cause a reliable and secure fit. The members have a smooth, soft finish which aids in preventing bodily harm to others or personal injury. The user thus has a simple and inexpensive way to protect transport and store skis. Should the skis be placed in the bottom member when there is still snow on the tails, the drain will prevent melting snow water from accumulating within the bottom member 12.

My construction solves all of the problems faced in the prior art. My two part ski accessory holds a pair of skis together in a secure and reliable fit. The top member covers and protects the tips of the skis when they are carried by an individual, transported in a vehicle or on a plane, or sent by United Parcel, for example. By covering the shovels, tails and associated edges injury to nearby people or property is minimized. Finally, the simplicity of placing the members on the skis, or removing them, as well as securing them together when not in use, adds to the pleasure and desire to use the invention.

As can be seen, the present invention provides a significant advance over the state of the technology. As numerous additions, modifications and constructions can be performed within the scope of the invention, such scope is to be measured by the claims herein.

What is claimed:

1. An improved ski accessory for holding ski tails and shovels together which comprises:

(a) a top member having two flexible wings conforming in general shape to the shovel of a ski, each defined by inner and outer walls forming a receptacle to receive the shovel of a ski, openings defined in the inner and outer walls of each wing;

(b) means to secure the two wings to each other;

(c) a bottom flexible member with an upper and bottom portions and having a receptacle sized to receive the tails of two skis, the top portion being more flexible than the bottom portion; and (d) the bottom member being sized to be received in frictional engagement within the openings in the walls of the wings, when the openings are in approximate alignment with each other whereby the two members are firmly, yet reliable secured to each other when not in use, and may be easily secured to a pair of skis to hold them together, protect the shovels and tails when transported, provide safety protection to other persons or property when transported, and be easily removed from the skis.

2. The invention according to claim 1 wherein the wings have side walls separating the inner and outer walls and secured thereto along the peripheral edges, the side walls and inner and outer walls defining the receptacle to receive the shovel of the ski.

3. The invention according to claim 2, wherein the inner openings on the inner walls are smaller in overall dimensions than the openings on the outer walls.

4. The invention according to claim 3 wherein the surface texture of the outer walls and side walls is smooth and soft.

5. The invention according to claim 1, wherein the bottom member has front and rear walls, at least two vertically extending ribs positioned on one of the front and rear walls, the ribs being located so that they are outside of the walls of the inner openings on the inner wall of the wings, thus securing the bottom member within the top member when desired.

6. The invention according to claim 5, where there are two pairs of substantially vertical parallel ribs on both the front and rear walls.

7. The invention according to claim 1 wherein the bottom portion has drainage means to allow removal of liquid from within the receptacle of the bottom member.

8. The invention according to claim 7, wherein the drainage means includes at least one opening positioned within the bottom portion of the bottom member.

9. The invention according to claim 8, wherein the bottom portion has a bottom wall, and an opening positioned in the bottom wall.

10. The invention according to claim 9, the bottom portion having another opening in order to prevent formation of a vacuum pressure.

11. The invention according to claim 7, the invention including a plurality of openings in the bottom portion.

12. The invention according to claim 3, wherein the bottom member has front and rear walls, at least two vertically extending ribs positioned on one of the front and rear walls, the ribs being located so that they are outside of the walls of the inner openings on the inner wall of the wings, thus securing the bottom member within the top member when desired.

13. The invention according to claim 12, where there are two pairs of substantially vertical parallel ribs on both the front and rear walls.

14. An improved accessory for protecting and holding ski tails and shovels together, which comprises:

(a) a top sleeve member having a ski shovel receptacle means to longitudinally receive the shovels of a pair of skis;

(b) a bottom sleeve member having a ski tail receptacle means to longitudinally receive the tails of said pair of skis;

(c) one of said top and bottom sleeve members having an opening defined transversely therethrough, the other of said members being yieldably and releasably received in said opening in frictional securement;

whereby the accessory members provide protection for and securement of said pair of skis when in use and provide for releasable securement to each other when not in use.

* * * * *